US008813623B2

(12) United States Patent
Armacost

(10) Patent No.: US 8,813,623 B2
(45) Date of Patent: Aug. 26, 2014

(54) ASSEMBLY FOR COPING AND MOUNTING TRIM MOLDING

(76) Inventor: Gregory Scott Armacost, Comer, GA (US)

( * ) Notice: Subject to any disclaimer, the term of this patent is extended or adjusted under 35 U.S.C. 154(b) by 0 days.

(21) Appl. No.: 13/214,296

(22) Filed: Aug. 22, 2011

(65) Prior Publication Data

US 2013/0047532 A1 Feb. 28, 2013

(51) Int. Cl.
*B26D 5/08* (2006.01)

(52) U.S. Cl.
USPC ..... 83/581; 83/694; 83/701

(58) Field of Classification Search
USPC ..... 83/196–200, 581, 686, 694, 701
See application file for complete search history.

(56) References Cited

U.S. PATENT DOCUMENTS

| | | | | |
|---|---|---|---|---|
| 3,209,417 | A * | 10/1965 | Fisher | 164/264 |
| 3,451,297 | A * | 6/1969 | Reis et al. | 83/198 |
| 5,001,877 | A | 3/1991 | Edwards | |
| 5,711,123 | A | 1/1998 | Lamont et al. | |
| 6,381,915 | B1 | 5/2002 | Wood | |
| 6,761,099 | B2 * | 7/2004 | Lin et al. | 83/200 |
| 7,107,889 | B2 * | 9/2006 | Marocco | 83/198 |
| 7,200,970 | B2 | 4/2007 | Koenig, Jr. et al. | |
| 7,506,567 | B2 * | 3/2009 | Simokovic | 83/196 |
| 2005/0166734 | A1 * | 8/2005 | Friend | 83/198 |
| 2006/0196144 | A1 | 9/2006 | Speck | |
| 2006/0272237 | A1 | 12/2006 | Koennig, Jr. et al. | |
| 2007/0022685 | A1 | 2/2007 | Koenig, Jr. et al. | |
| 2008/0016807 | A1 | 1/2008 | Barter | |
| 2008/0172964 | A1 | 7/2008 | de Raucourt | |

* cited by examiner

*Primary Examiner* — Sean Michalski
(74) *Attorney, Agent, or Firm* — Taylor English Duma LLP

(57) ABSTRACT

An assembly for coping and mounting trim molding is provided. A trim holding device for mounting a finish trim molding and a coping device are provided. The coping device includes a platform, having a back, into which to place a finish trim molding for coping and cutting, and a blade assembly having a cutter blade and configured to be manually actuated by a lever. The blade assembly is adjustable and is configured to rotate. The cutter blade is configured specifically to a size and a shape of the finish trim molding to be cut and coped. The mounting device includes a bracket, having a pair of mounting flanges, configured for placement along a wall. The bracket and flanges form generally an "F" shape trim holding device. The flanges are configured to securely hold a finish trim molding without the use of nails, glues, and adhesives.

9 Claims, 8 Drawing Sheets

ASSEMBLY FOR COPING AND MOUNTING TRIM MOLDING

FIELD OF THE INVENTION

The technology described herein relates generally to finish carpentry. More specifically, this technology relates to an assembly and associated methods for coping and mounting trim molding.

BACKGROUND OF THE INVENTION

Trim molding, such as decorative architectural molding, is used in finish carpentry to adorn walls, ceilings, corners, and the like. For example, baseboards, chair rails, and crown molding are all various types of decorative architectural molding. In order to properly fit such molding pieces into corners, angled cutting, such as miter-cutting or cope-cutting, can be used to create angled cuts. Traditional miter-cutting at forty-five degree angles may provide a square joint but often does not work since most wall corners are not square, and, thus, do not have a true ninety-degree angle. Most corners, in fact, are not square due to framing issues, drywall imperfections, drying and cracking, and the like.

Cope joints, however, which use one trim molding piece butted against an adjacent wall at the corner, eliminate the concern of non-square corners. Cope joints allow for a tight fit regardless of the corner angle. Cope joints are also less likely to show gaps. Once molding has been properly cut, it is secured to a ceiling, wall, or the like. For example, a crown molding is secured between a wall and a ceiling. Nails, glues, and adhesives are known methods by which to secure the molding.

Related patents known in the art include the following. U.S. Pat. No. 5,001,877, issued to Edwards on Mar. 26, 1991, discloses a decorative wall and ceiling molding assembly. U.S. Pat. No. 5,711,123, issued to Lamont et al. on Jan. 27, 1998, discloses a decorative molding with removable decorative panel. U.S. Pat. No. 6,381,915, issued to Wood on May 7, 2002, discloses an architectural molding and mounting device. U.S. Pat. No. 7,200,970, issued to Koenig, Jr. et al. on Apr. 10, 2007, discloses a combination comprising vertical wall, horizontal ceiling, and crown molding member having planar portion, intermediate portion, and mounting flange.

Related published patent applications known in the art include the following: U.S. Patent Application Publication No. 2006/0196144, filed by Spek and published on Sep. 7, 2006, discloses a crown molding. U.S. Patent Application Publication No. 2006/0272237, filed by Koenig, Jr. et al. and published on Dec. 7, 2006, discloses a crown molding assembly and related kit. U.S. Patent Application Publication No. 2007/0022685, filed by Koenig, Jr. et al. and published on Feb. 1, 2007, discloses a crown molding member having planar portion, intermediate portion, and mounting flange. U.S. Patent Application Publication No. 2008/0016807, filed by Barter and published on Jan. 24, 2008, discloses a crown molding hanger aid. U.S. Patent Application Publication No. 2008/0172964, filed by de Raucourt and published on Jul. 24, 2008, discloses an installation bracket and system for crown molding.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides for an assembly and associated methods for coping and mounting finish trim molding.

In one exemplary embodiment, the technology described herein provides a trim holding device for mounting a finish trim molding. The trim holding device includes a mounting bracket configured for secure placement along a vertical wall, parallel to the wall, and a pair of mounting flanges disposed upon the mounting bracket, perpendicular to the mounting bracket. A combination of the mounting bracket and the pair of mounting flanges forms generally an "F" shape trim holding device. The mounting flanges are configured to receive and securely hold a finish trim molding without the use of nails, glues, and adhesives.

The trim holding device can also include a barb disposed upon each of the pair of mounting flanges on an end toward the received finish trim molding, such that the barbs securely hold the finish trim molding to the wall.

The trim holding device can further include a plurality of nodules disposed upon an upper side and a lower side of each of the pair of mounting flanges, the plurality of nodules configured to provide an additional hold to the finish trim molding.

The trim holding device can also include a ceiling stop, disposed upon a top of the mounting bracket, perpendicular to the mounting bracket. When the finish trim molding is a crown molding, for example, the ceiling stop is configured to provide spacing to fit the crown molding between the wall and a ceiling.

The trim holding device can be manufactured from a plastic or metal material, or the like. The material of manufacture can be extruded.

In another exemplary embodiment, the technology described herein provides a finish trim molding. The finish trim molding includes a pair of channels, generally horizontal and parallel to one another, formed into the finish trim molding in a generally perpendicular manner relative to a wall upon which the finish trim molding is to be mounted. The pair of channels in the finish trim molding is configured to receive a pair of mounting flanges on a mounting bracket of a trim holding device mounted to the wall. The finish trim molding is configured to be received by the pair of mounting flanges and is securely held to the wall without the use of nails, glues, and adhesives.

The finish trim molding can also include a horizontal cut out disposed on a top surface of the finish trim molding and configured to accommodate rough surfaces upon which the finish trim molding is to cover.

The finish trim molding can further include a vertical cut out disposed on a rear surface of the finish trim molding and configured to provide an allowance for the mounting bracket.

In yet another exemplary embodiment, the technology described herein provides a coping device for coping finish trim molding. The coping device includes a platform, having a back perpendicular to the platform and forming generally an L shape into which to place a finish trim molding for coping and cutting and a blade assembly having a cutter blade and configured to be manually actuated by a lever selectively managed by an operator. The lever further includes a handle by which the lever is grasped by an operator and by which the cutter blade is depressed downwardly to cut the finish trim molding. The blade assembly is adjustable and is configured to rotate to the right and the left five degrees from a center. The cutter blade is configured specifically to a size and a shape of the finish trim molding to be cut and coped. The cutter blade is configured to be reversed in the blade assembly to provide operation at an opposite angle.

The coping device also includes a cutter plate disposed with the platform and configured to accommodate the cutter blade as it is actuated and pressed down through the finish trim molding. The coping device also includes an opening on the cutter plate through which the cutter blade passes when depressed through the finish trim molding. The cutter plate is configured to be reversed in the platform to receive the cutter blade when the cutter blade is operated at an opposite angle.

The coping device also can further include a plurality of interchangeable cutter blades, each cutter blade configured to a specific profile desired to be cut into the finish trim molding. The coping device also includes a pivot upon which the blade assembly having the cutter blade is moved by the lever. The coping device is a manual, non-electric device.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
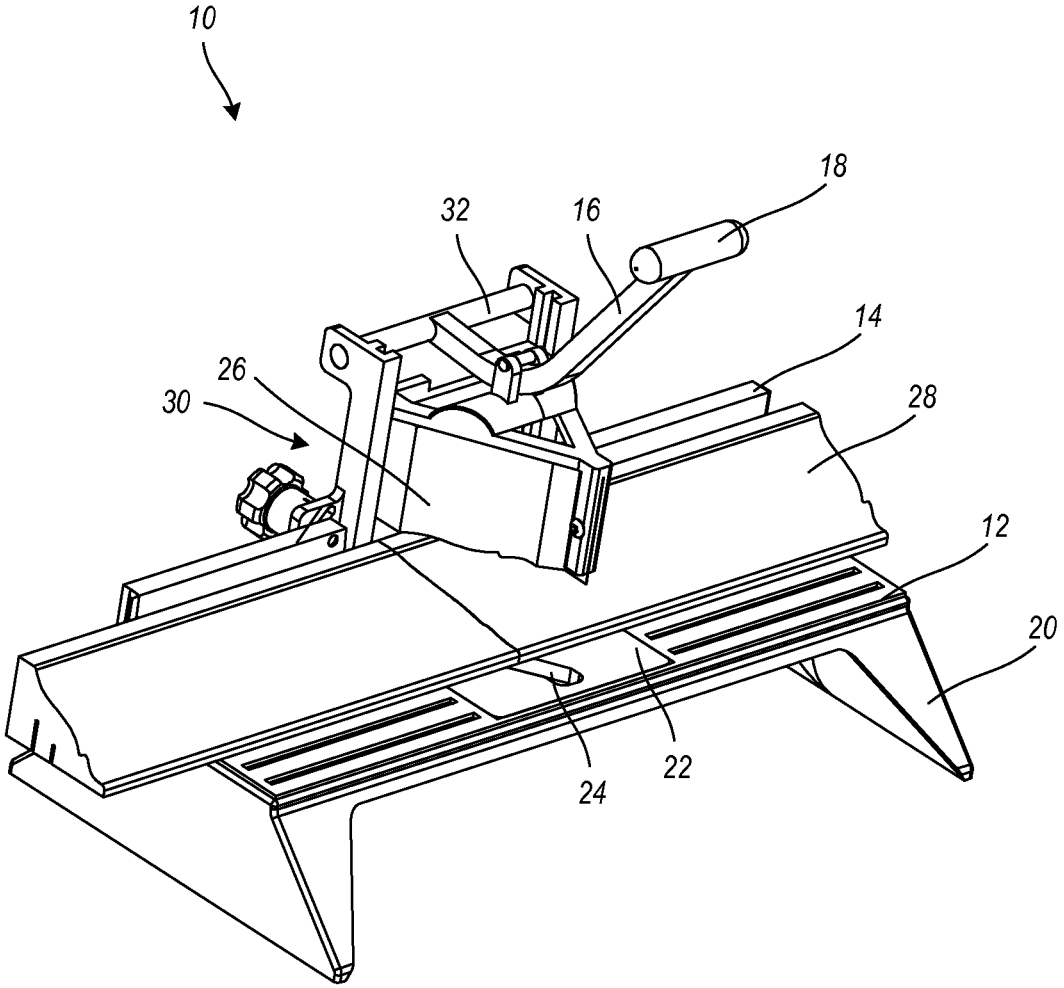
FIG. 1 is a front perspective view of a coping device for coping finish trim molding, illustrated with a piece of finish trim molding to be coped, according to an embodiment of the technology described herein.
Figure 2:
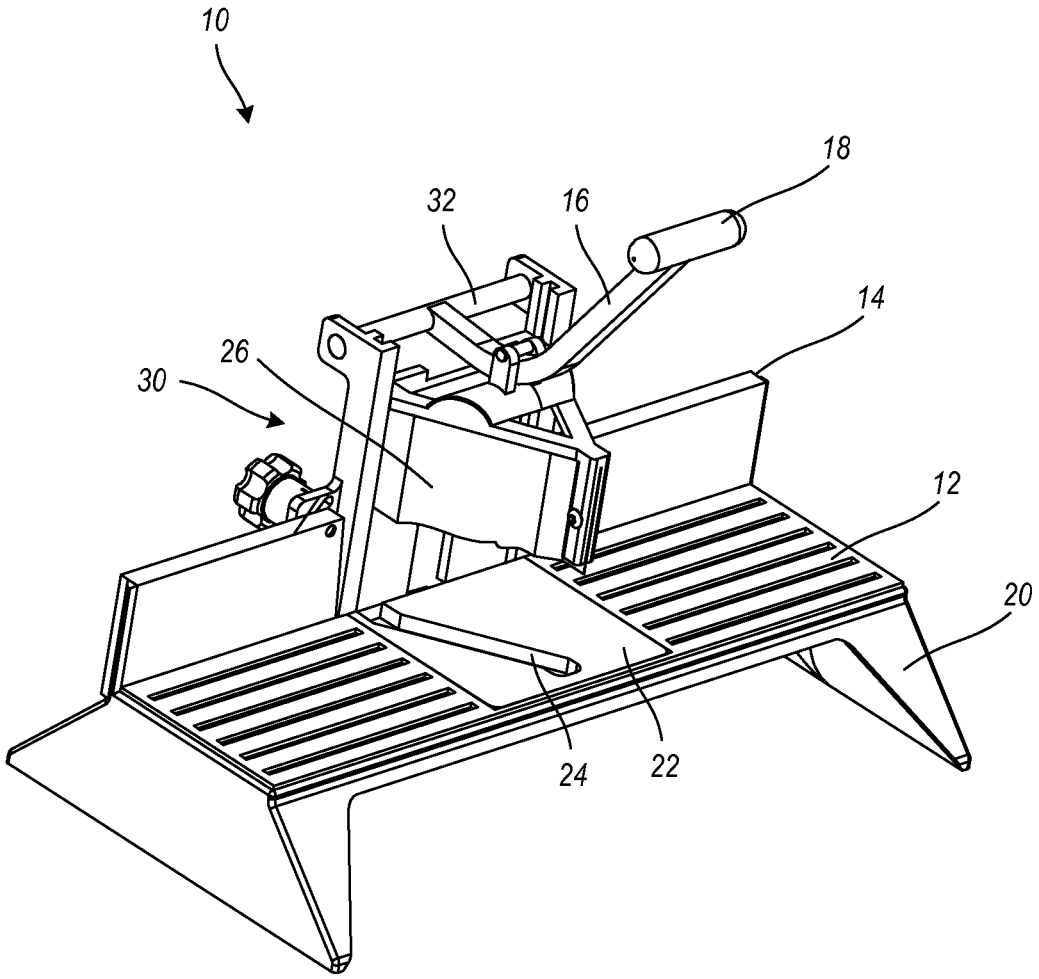
FIG. 2 is an a front perspective view of the coping device for coping finish trim molding depicted in FIG. 1, shown without the piece of finish trim molding.
Figure 3:
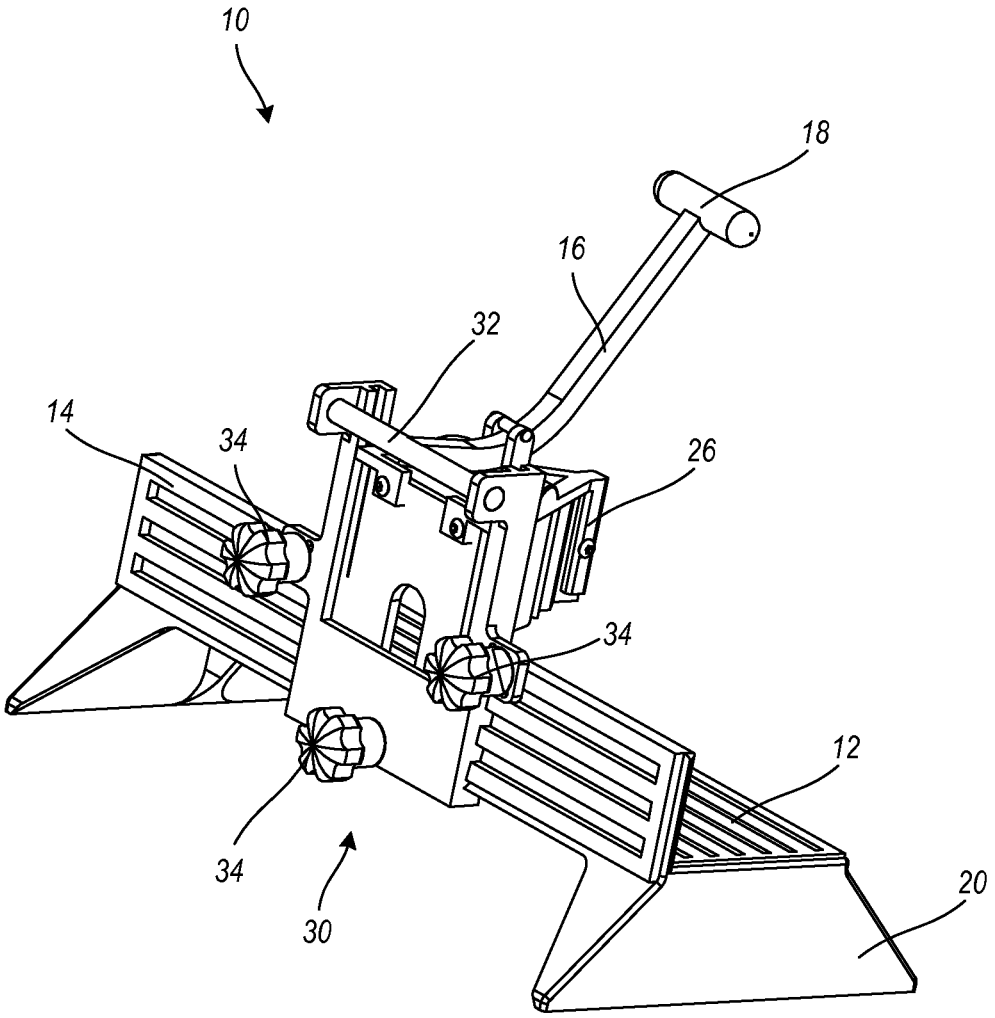
FIG. 3 is a rear perspective view of the coping device for coping finish trim molding depicted in FIG. 1.
Figure 4:
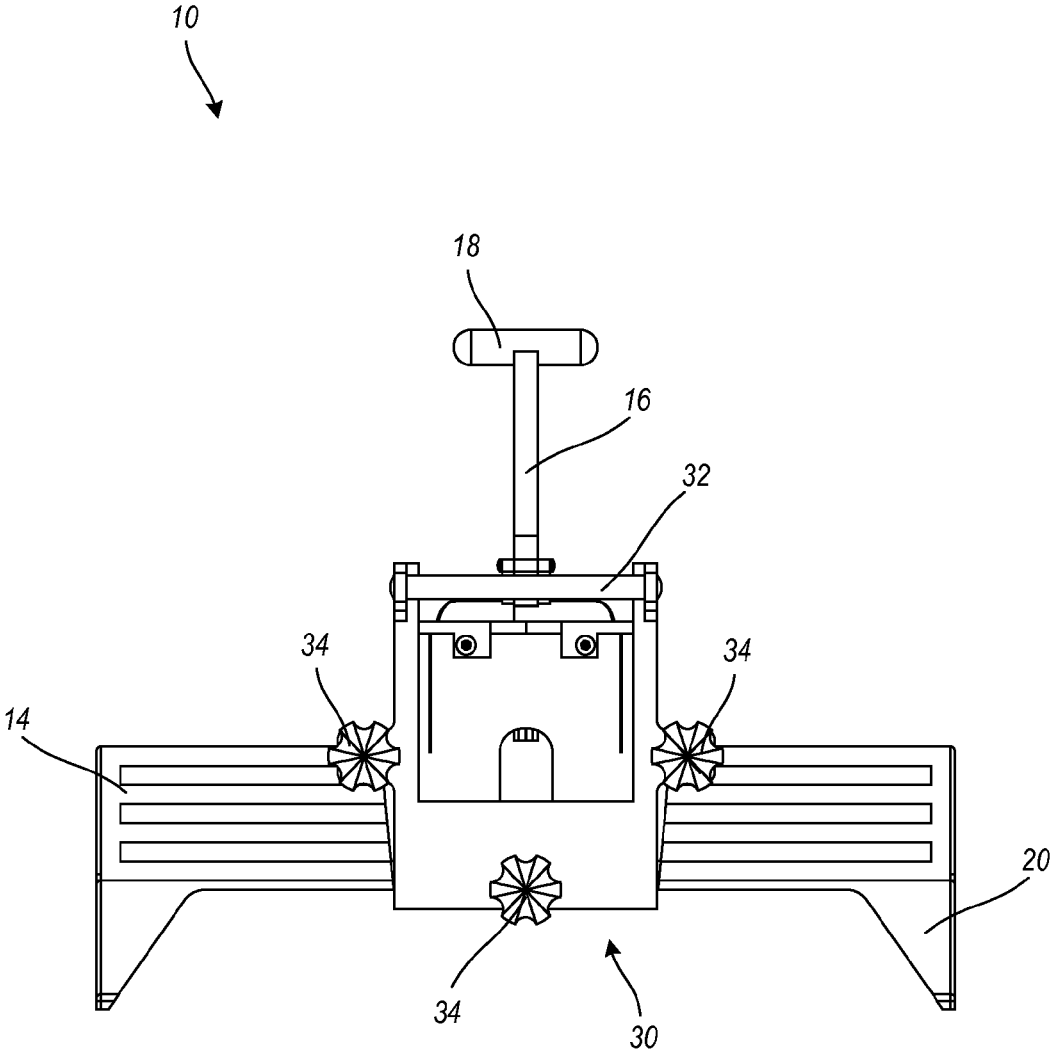
FIG. 4 is a rear planar view of the coping device for coping finish trim molding depicted in FIG. 1.
Figure 5:
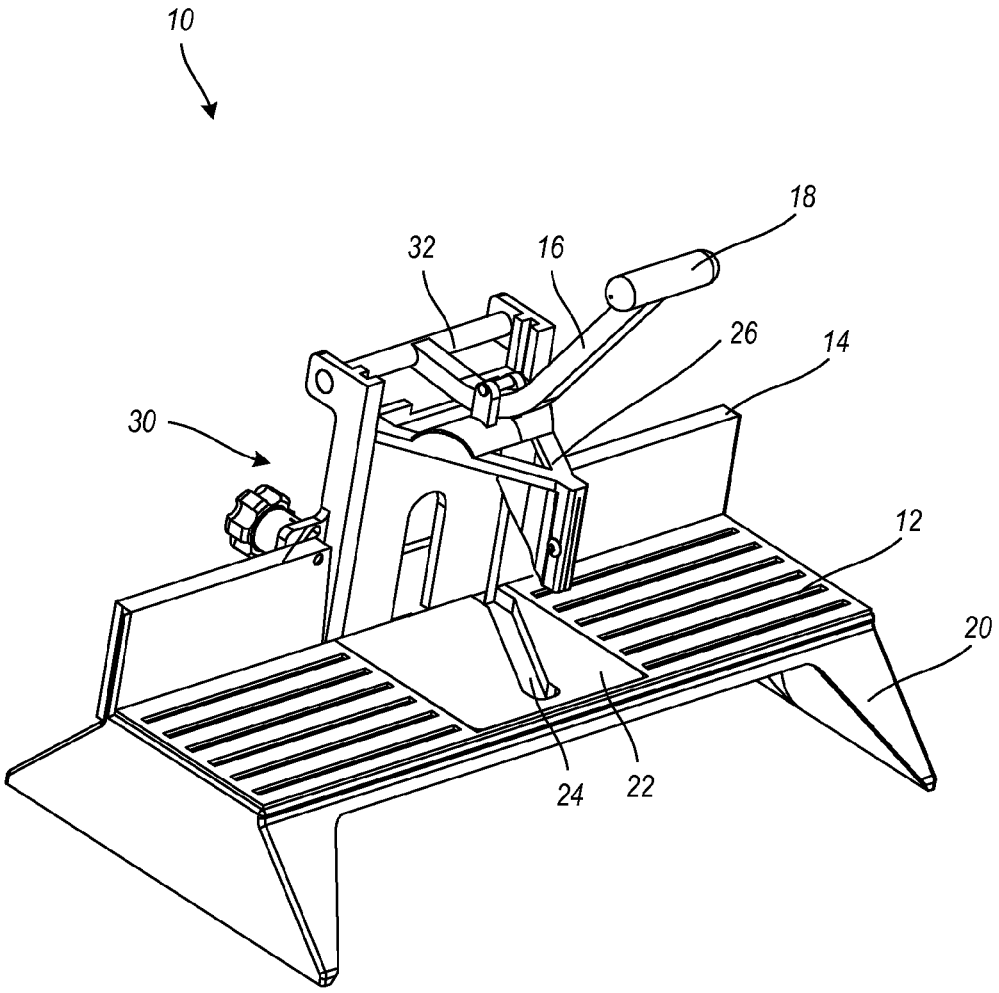
FIG. 5 is a front perspective view of the coping device for coping finish trim molding depicted in FIG. 1, shown, in particular, with the cutting plate reversed.
Figure 6:
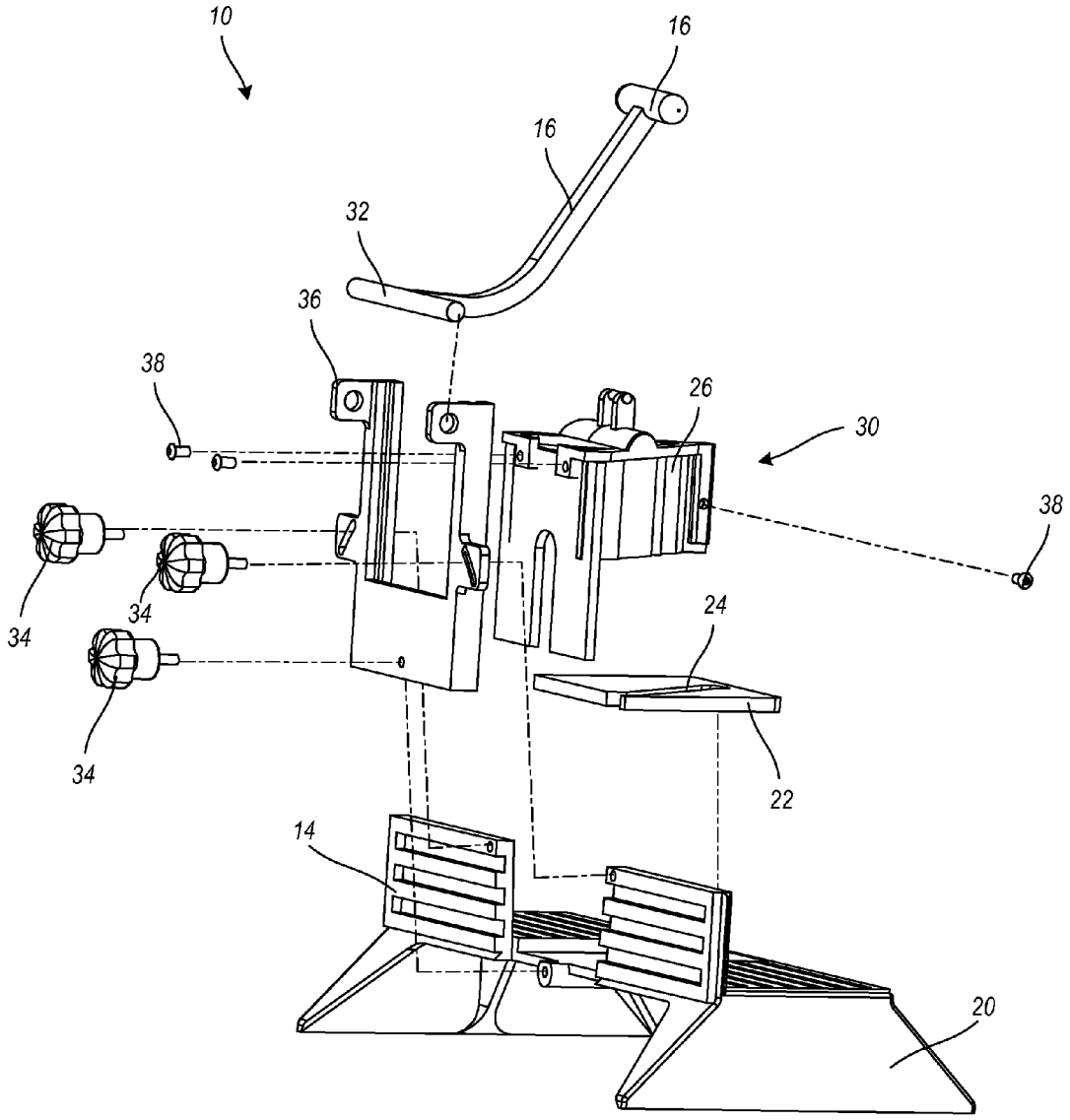
FIG. 6 is an exploded rear perspective view of the coping device for coping finish trim molding depicted in FIG. 1.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides for an assembly and associated methods for coping and mounting finish trim molding.

Referring now to the Figures, a coping device 10 for coping finish trim molding is shown. The coping device 10 depicted is a manual, non-electric device. The coping device 10 can be used, for example, to cut a piece of finish trim molding 28, such as a piece of foam trim. When finish trim meets in a corner, the corner is not always originally found at a perfect 90 degree angle. Under such circumstances, one can cope the trim so that no matter what angle the corner is originally, the trim fits tight and looks aesthetically pleasing. The coping device 10 is used to cope the finish trim molding 28 like a guillotine. One slice, or down and up motion, with the blade and the finish trim molding 28 is perfectly coped.

The coping device 10 allows one to cope a piece of finish trim molding 28, in a matter of seconds. Use of the coping device 10 provides a cope with mechanical accuracy to provide mechanical precision rather than result in a human operator inconsistency. Use of the coping device 10 provides for the creation of corner joints without the need for prefabricated foam trim corners.

The coping device 10 includes a platform 12, having a back 14 perpendicular to the platform 12 and forming generally an L shape into which to place a finish trim molding 28 for coping and cutting. The platform 12 is disposed upon a base 20 to provide a level support. The platform 12 is, for example, manufactured of a lightweight aluminum material.

The coping device 10 includes a blade assembly 30 having a cutter blade 26. The blade assembly 30 is adjustable and is configured to rotate, for example, to a right and a left five degrees from a center. The cutter blade 26 is configured specifically to a size and a shape of the finish trim molding 28 to be cut and coped. The cutter blade 26 is configured to be reversed in the blade assembly 30 to provide operation at an opposite angle. The cutter blade 26 is easily interchanged with a replacement blade, or a blade of a different specification to accommodate the cope needs of another size or shape of finish trim molding 28.

The coping device 10 is configured to be manually actuated by a lever 16, selectively managed by an operator. The lever 16 can further include a handle 18 by which the lever 16 is grasped by an operator and by which a cutter blade 26 is depressed downwardly to cut the finish trim molding 28. The blade assembly 30 can further include a pivot rod 32 upon which the lever 16 can pivot when raising and lowering the cutter blade 26 into the finish trim molding 28.

The coping device 10 includes a cutter plate 22 disposed with the platform 12 and configured to accommodate the cutter blade 26 as it is actuated and pressed down through the finish trim molding 28. The cutter blade 26 includes an opening 24 through which the cutter blade 26 passes when depressed through the finish trim molding 28. The cutter plate 22 is configured to be reversed in the platform 12 to receive the cutter blade 26 when the cutter blade 26 is operated at an opposite angle.

The coping device 10 can include a plurality of interchangeable cutter blades 26, each cutter blade 26 configured to a specific profile desired to be cut into the finish trim molding 28. The blade assembly 30 of the coping device 10 is configured such that blades 26 are easily and quickly interchanged or replaced.

The blade assembly 30 of the coping device 10 can be slidably secured to the back 14 with adjustable knobs 34. The knobs 34 are easily loosened and tightened by hand by an operator.

The blade assembly 30 can include frame 36, to which the cutter blade 26 secured, and to which the base 30 of the coping device 10 is secured. Screws 38 can be utilized to secure the elements of the blade assembly 30 one to another. This configuration allows for the blade assembly 30 to adjust and rotate from a center position.

In operation, the coping device 10 can functions without "reading" the finish trim molding 28 to be coped. The finish trim molding 28 can be wood, foam, or the like. Known coping devices generally accept all shapes and sizes of trim pieces and read the profile of the trim before coping it. Such machines are large, cumbersome, and electric. The coping device 10 described herein is configured to cope only one size and shape of finish trim molding 28 at a time. To accommodate finish trim molding 28 of another size or shape, the blade assembly 30 cutter blade 26 is swapped with another that matches the finish trim molding 28 to be cut. There exists only one trim profile per cutter blade 26, so each cutter blade 26 is specific to the trim it is used upon. The cutter blade 26 is only to be used on the finish trim molding 28 for which it is designed. In any given profile of trim there is always the exact same amount of wood or foam that needs to be removed to make a cope. The coping device 10 is configured to cut that exact amount and, therefore, does not need to "read" the trim. If the size of shape of finish trim molding 28 is changed, a new cutter blade 26 is utilized.

Figure 7:
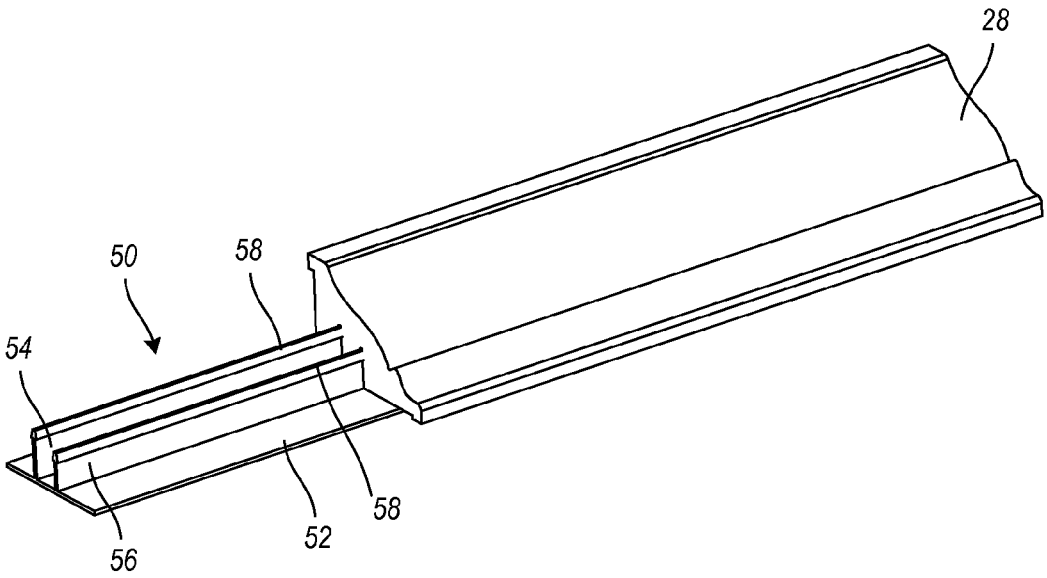
FIG. 7 is a perspective view of a trim holding device, according to an embodiment of the technology described herein, and illustrating, in particular, the attachment of a piece of finish trim molding to the trim holding device.
Figure 8:
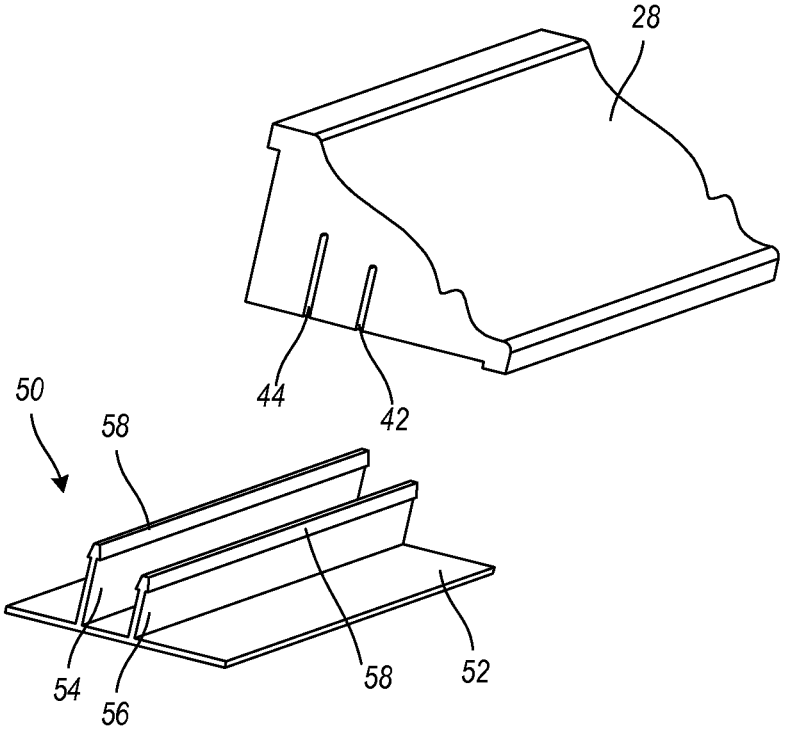
FIG. 8 is a perspective view of the trim holding device depicted in FIG. 7, illustrating, in particular, the method by which the finish trim molding is attached to the trim holding device.

Referring now to FIGS. 7 and 8, a trim holding device 50 is shown. The trim holding device 50 includes a mounting bracket 52 configured for secure placement along a vertical wall, parallel to the wall. Disposed upon the mounting bracket 52 is a pair of mounting flanges, such as top flange 54 and bottom flange 56, perpendicular to the mounting bracket. A combination of the mounting bracket 52 and the pair of mounting flanges 54, 56 forms generally an "F" shape trim holding device 50. The mounting flanges 54, 56 are configured to receive and securely hold a finish trim molding 28 without the use of nails, glues, and adhesives. Although depicted with two mounting flanges 54, 56, an alternative number of flanges can be utilized to securely hold finish trim molding 28 to a wall, or the like.

The trim holding device 50 can be manufactured from plastic, metal, and the like. The trim holding device 50 can be manufactured from an extrusion process. The trim holding device 50 can be secured to a wall with screws, adhesive, and so forth. However, no nails, glues, adhesives, screws, etc. are utilized between the trim holding device 50 and the finish trim molding 28.

The mounting flanges 54, 56 can further include a barb 58 disposed upon each of the pair of mounting flanges 54, 56 on an end toward the received finish trim molding 28, such that the barbs securely hold the finish trim molding 28 to the wall.

The mounting flanges 54, 56 can further include a plurality of nodules (not shown) disposed upon an upper side and a lower side of each of the pair of mounting flanges 54, 56, the plurality of nodules configured to provide an additional hold to the finish trim molding 28.

The trim holding device 50 can further include a ceiling stop (not shown), disposed perpendicularly upon a top of the mounting bracket 52. The finish trim molding is, for example, a crown molding and the ceiling stop is configured to provide spacing to fit the crown molding between the wall and a ceiling.

As depicted in FIG. 8, the finish trim molding 28 can include a pair of channels 42, 44 generally horizontal and parallel to one another, formed into the finish trim molding 28 in a generally perpendicular manner relative to a wall upon which the finish trim molding 28 is to be mounted. The pair of channels 42, 44 in the finish trim molding 28 is configured to receive a pair of mounting flanges 54, 56 on a mounting bracket 52 of a trim holding device 50 mounted to the wall. The finish trim molding 28 is configured to be received by the pair of mounting flanges 54, 56 and is securely held to the wall without the use of nails, glues, and adhesives. The pair of channels 42, 44 can be pre-cut, cut on site, or made by the trim holding device 50 as the finish trim molding 28 is installed.

The finish trim molding 28 can include a horizontal cut out (not shown) disposed on a top surface of the finish trim molding 28 and configured to accommodate rough surfaces upon which the finish trim molding 28 is to cover.

The finish trim molding 28 can include a vertical cut out (not shown) disposed on a rear surface of the finish trim molding 28 and configured to provide an allowance for the mounting bracket 52.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered by the following claims.

What is claimed is:

1. A coping device for coping finish trim molding, the coping device comprising:

a platform, having a back perpendicular to the platform and forming generally an L shape into which to place a finish trim molding for coping and cutting; and a blade assembly having a cutter blade and configured to be manually actuated by a lever selectively managed by an operator;

wherein the blade assembly is adjustable and is configured to rotate to a right and a left five degrees from a center; and wherein the cutter blade is configured specifically to a size and a shape of the finish trim molding to be cut and coped.

2. The coping device of claim 1, wherein the cutter blade is configured to be reversed in the blade assembly to provide operation at an opposite angle.

3. The coping device of claim 1, further comprising:

a cutter plate disposed with the platform and configured to accommodate the cutter blade as it is actuated and pressed down through the finish trim molding.

4. The coping device of claim 3, further comprising:

an opening on the cutter plate through which the cutter blade passes when depressed through the finish trim molding.

5. The coping device of claim 3, wherein the cutter plate is configured to be reversed in the platform to receive the cutter blade when the cutter blade is operated at an opposite angle.

6. The coping device of claim 1, further comprising:

a plurality of interchangeable cutter blades, each cutter blade configured to a specific profile desired to be cut into the finish trim molding.

7. The coping device of claim 1, wherein the lever further comprises a handle by which the lever is grasped by an operator and by which the cutter blade is depressed downwardly to cut the finish trim molding.

8. The coping device of claim 1, further comprising:

a pivot upon which the blade assembly having the cutter blade is moved by the lever.

9. The coping device of claim 1, wherein the coping device is a manual, non-electric device.

* * * * *